US009199112B2

(12) United States Patent
Chen

(10) Patent No.: US 9,199,112 B2
(45) Date of Patent: Dec. 1, 2015

(54) LOWER LIMB STRETCHING WORKOUT DEVICE

(71) Applicant: ST LIFE CO., LTD., Changhua County (TW)

(72) Inventor: Jue-Yao Chen, Changhua County (TW)

(73) Assignee: ST LIFE CO., LTD., Changhua County (TW)

( * ) Notice: Subject to any disclaimer, the term of this patent is extended or adjusted under 35 U.S.C. 154(b) by 73 days.

(21) Appl. No.: 14/217,580

(22) Filed: Mar. 18, 2014

(65) Prior Publication Data

US 2015/0265868 A1 Sep. 24, 2015

(51) Int. Cl.

| | |
|---|---|
| ***A63B 26/00*** | (2006.01) |
| ***A63B 21/00*** | (2006.01) |
| ***A63B 23/04*** | (2006.01) |
| *A63B 23/00* | (2006.01) |

(52) U.S. Cl.

CPC ..... *A63B 21/00181* (2013.01); *A63B 21/00021* (2013.01); *A63B 21/1465* (2013.01); *A63B 23/04* (2013.01); *A63B 2023/006* (2013.01)

(58) Field of Classification Search

CPC ..... A63B 21/00181; A63B 21/00021; A63B 21/1465; A63B 23/04; A63B 2023/006; A63B 21/00178; A63B 21/005; A63B 21/0058; A63B 2021/0059; A63B 22/02; A63B 22/201; A63B 22/203; A63B 23/0405; A63B 23/0417; A63B 23/0423; A63B 23/0429; A63B 23/0458; A63B 23/047; A63B 23/0482; A63B 23/0464; A63B 23/0476; A63B 23/0488; A63B 23/0494; A63B 2023/0411; A63B 2023/0435; A63B 2023/0441; A63B 2023/0447; A63B 2023/0452; A63B 2208/0204; A61H 2001/0248; A61H 2201/0157; A61H 2201/12; A61H 2201/1207; A61H 2201/1215; A61H 2201/1436; A61H 2201/149; A61H 2201/164; A61H 2201/1664; A61H 2203/04; A61H 2203/0406; A61H 2205/10; A61H 2205/106; A61H 2205/108; A61H 2205/12

USPC ..... 601/23, 27, 29, 31, 33, 35, 84, 89, 90, 601/93, 97, 98, 101, 103, 104; 482/907

See application file for complete search history.

(56) References Cited

U.S. PATENT DOCUMENTS

| | | | | |
|---|---|---|---|---|
| 4,506,884 | A * | 3/1985 | Hankin | 482/131 |
| 5,271,416 | A * | 12/1993 | Lepley | 600/595 |
| 5,328,427 | A * | 7/1994 | Sleamaker | 482/71 |
| 5,989,163 | A * | 11/1999 | Rodgers, Jr. | 482/70 |
| 8,986,168 | B2 * | 3/2015 | Chen | 482/52 |
| 2011/0152731 | A1 * | 6/2011 | Ochi et al. | 601/5 |

* cited by examiner

*Primary Examiner* — Oren Ginsberg
*Assistant Examiner* — Megan Anderson
(74) *Attorney, Agent, or Firm* — Alan D. Kamrath; Kamrath IP Lawfirm, P.A.

(57) ABSTRACT

A lower limb stretching workout device includes a frame unit, two sliding plates, a motor assembly, and two cranks. The frame unit has two guide rails opposing each other. Rollers are disposed at the sliding plates and slidingly movable along the guide rails. The cranks each have a driving end and an acting end. The driving end is pivotally connected to a cam. The acting end is pivotally connected to a lug beneath each of the sliding plates. The motor assembly drives a rotating shaft to rotate through a transmission module. The torque of the rotating shaft is converted by the cams into a push/pull for driving the cranks to push/pull the sliding plates, thereby causing the sliding plates to slidingly move toward each other and away from each other. A user's two feet rest on the sliding plates, respectively, to stretch the user's lower limbs by extension and flexion.

4 Claims, 7 Drawing Sheets

LOWER LIMB STRETCHING WORKOUT DEVICE

BACKGROUND OF THE INVENTION

1. Technical Field

The present invention relates to the technical field of workout equipment, and more particularly, to a lower limb stretching workout device for stretching the lower limbs by extension and flexion.

2. Description of Related Art

Various commercially available workout devices work muscles in every parts of the human body. The workout devices related to the lower limbs include treadmills, stair steppers, and elliptical trainers. Every regular user of the aforesaid workout devices understands that they work the front and rear muscles in the lower limbs.

In fact, a lower limb workout is not restricted to the front and rear muscles in the lower limbs but also includes stretching the inner and outer muscles in the lower limbs in order for the lower limb workout to be complete. Moreover, when carried out solely by the lower limbs, that is, without any external exercise aid, a lower limb workout is exhausting and thus likely to be discouraging to the regular workout device users.

SUMMARY OF THE INVENTION

It is an objective of the present invention to provide a lower limb stretching workout device characterized in that: a motor assembly drives two cams; the two cams drive two cranks to pull two sliding plates to slide toward each other and away from each other; and a user's two feet rest on the two sliding plates, respectively, to extend and flex together with the two sliding plates, thereby stretching the user's lower limbs by extension and flexion.

In order to achieve the above and other objectives, the present invention provides a lower limb stretching workout device, comprising: a frame unit having two guide rails opposing each other; two sliding plates each with two edges having a plurality of rollers slidingly movable along the two guide rails and within a guiding range; a motor assembly for driving a rotating shaft through a transmission module, the motor assembly comprising a motor holder, a motor, and a motor spindle, the motor being fastened to the motor holder, the motor spindle penetrating the motor and protruding from a side of the motor to reach the motor holder, the transmission module comprising first through fourth belt pulleys, first and second belts, and an axle rod, the axle rod being fixed to the motor holder, the first belt pulley being fixed to the motor spindle, the fourth belt pulley being fixed to the rotating shaft, the second and third belt pulleys being fixed to each other, the second and third belt pulleys being pivotally connected to the axle rod, the first belt being wound around the first and second belt pulleys, the second belt being wound around the third and fourth belt pulleys; and the two cranks each having a driving end and an acting end, the driving end being pivotally connected to a cam, and the acting end being pivotally connected to a lug at a bottom surface of each of the two sliding plates, wherein, when the motor assembly drives the transmission module such that the transmission module drives the rotating shaft to rotate, a torque of the rotating shaft is converted by the cams into a push and a pull for driving the two cranks to push and pull the two sliding plates, thereby causing the two sliding plates to slidingly move toward each other and away from each other. The user's two feet rest on the two sliding plates, respectively, to extend and flex together with the two sliding plates, thereby stretching the user's lower limbs by extension and flexion.

DETAILED DESCRIPTION OF THE EMBODIMENT OF THE INVENTION

The present invention provides a lower limb stretching workout device.

Figure 1:
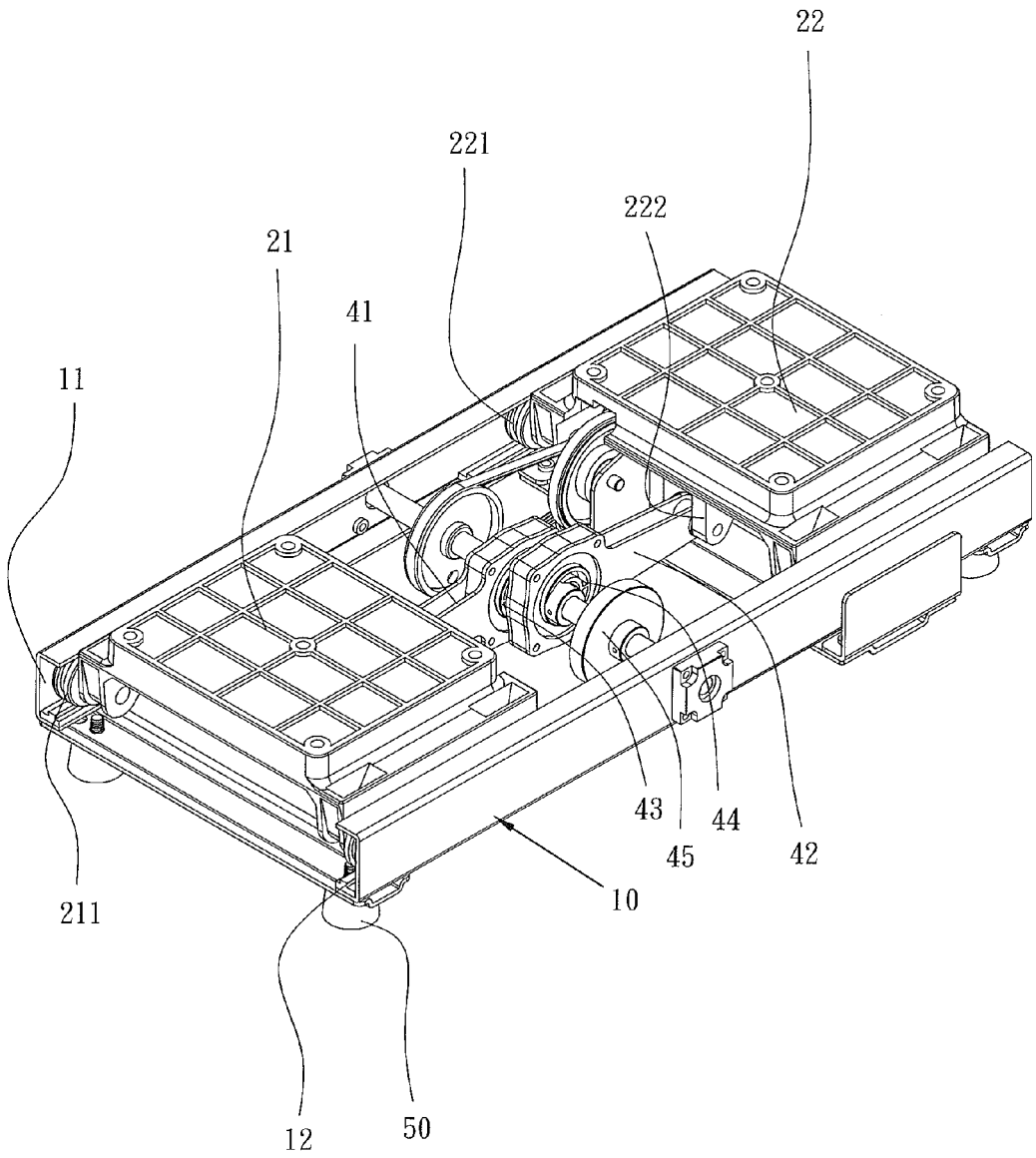
FIG. 1 is a perspective schematic view of the embodiment of the present invention.
Figure 2:
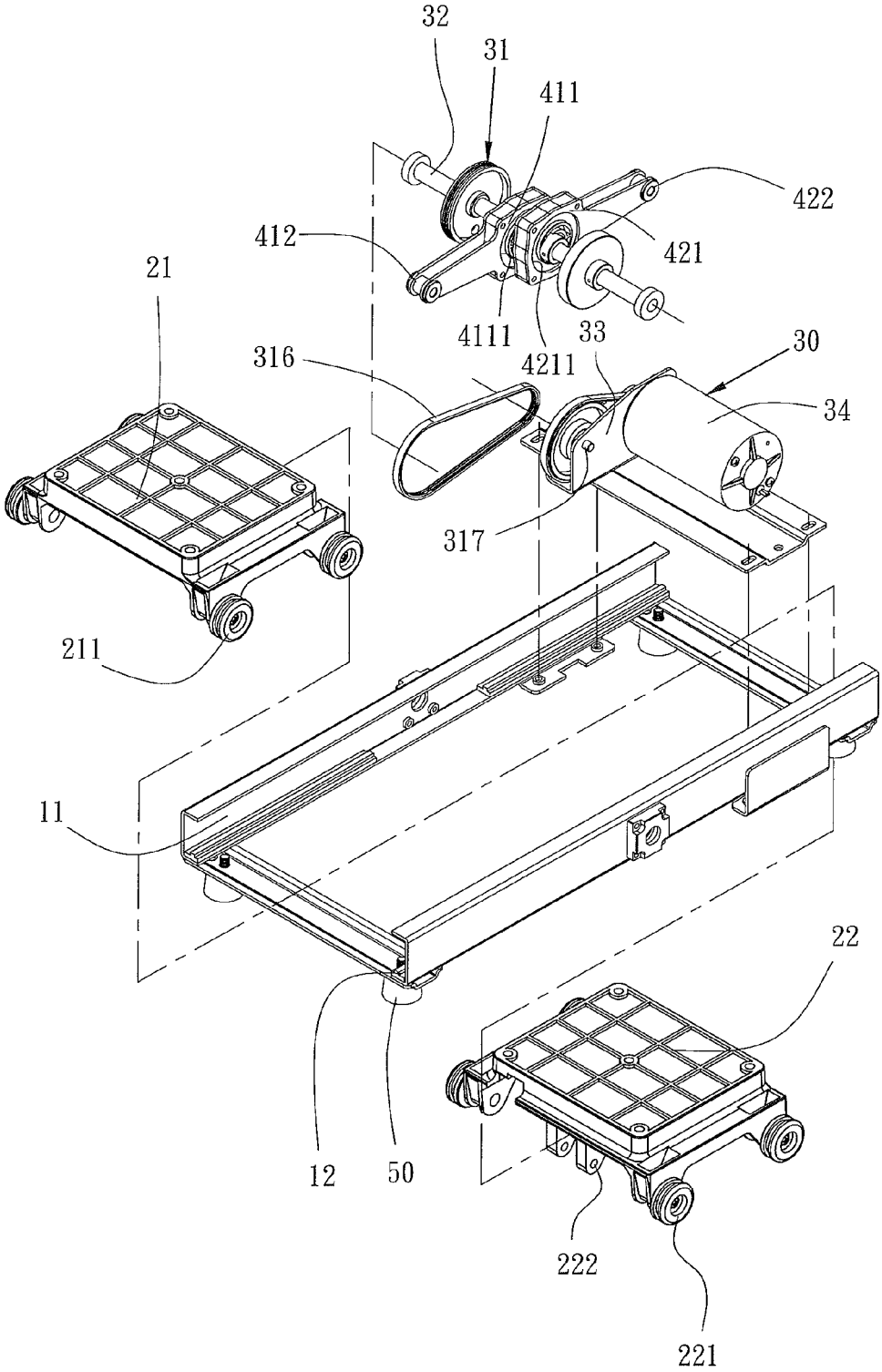
FIG. 2 is an exploded view of the embodiment of the present invention.
Figure 3:
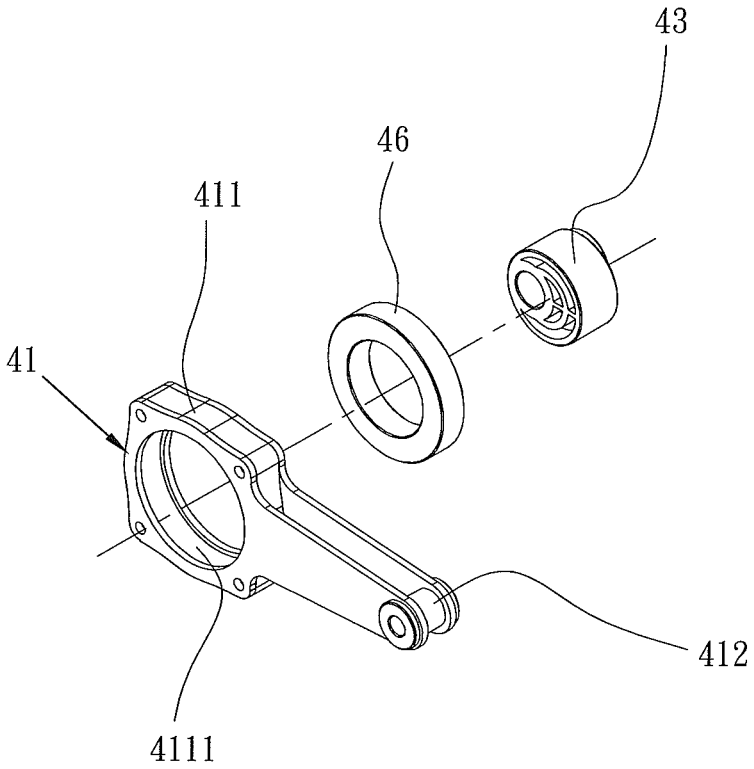
FIG. 3 is an exploded view of a crank and a cam according to the embodiment of the present invention.
Figure 4:
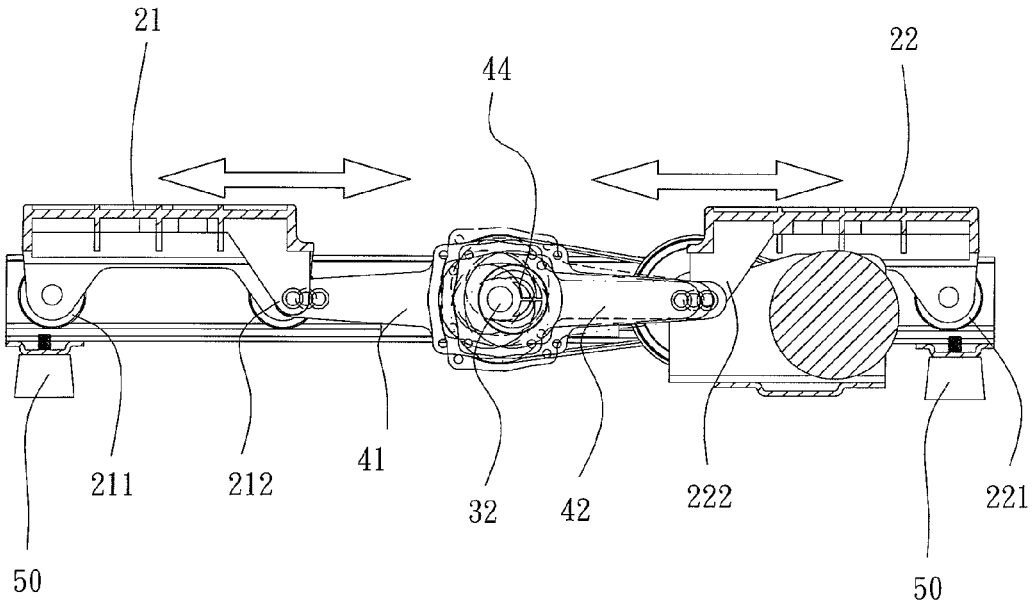
FIG. 4 is a lateral schematic view of a push and a pull of the cranks according to the embodiment of the present invention.
Figure 5:
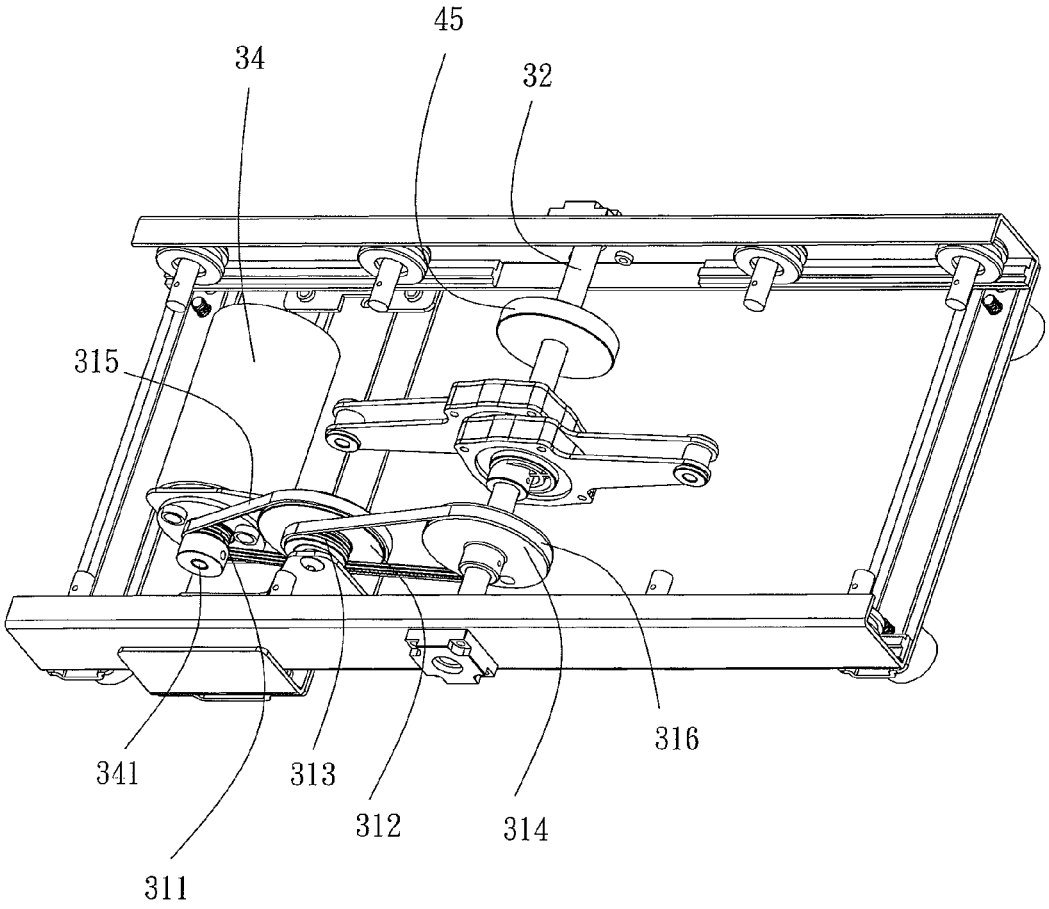
FIG. 5 is a partial perspective schematic view of a transmission module according to the embodiment of the present invention.
Figure 6:
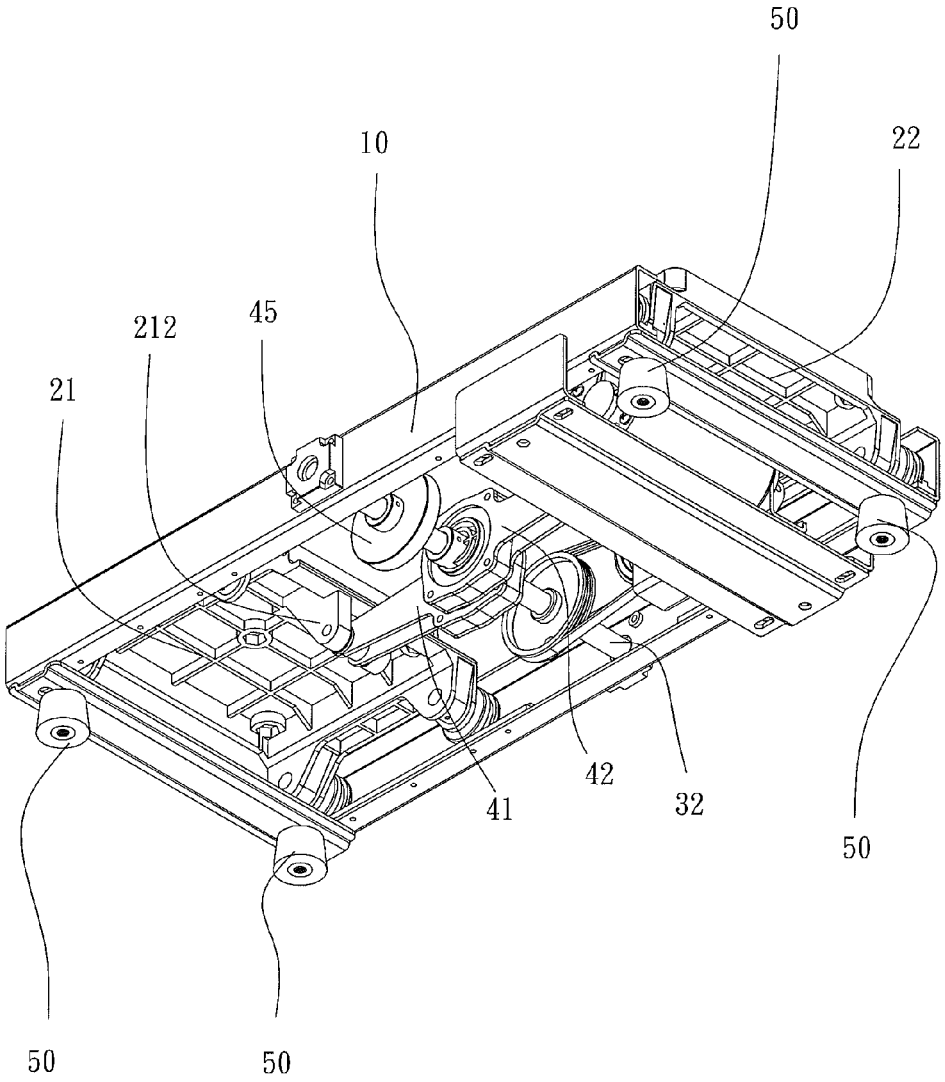
FIG. 6 is a bottom perspective schematic view of the embodiment of the present invention.
Figure 7:
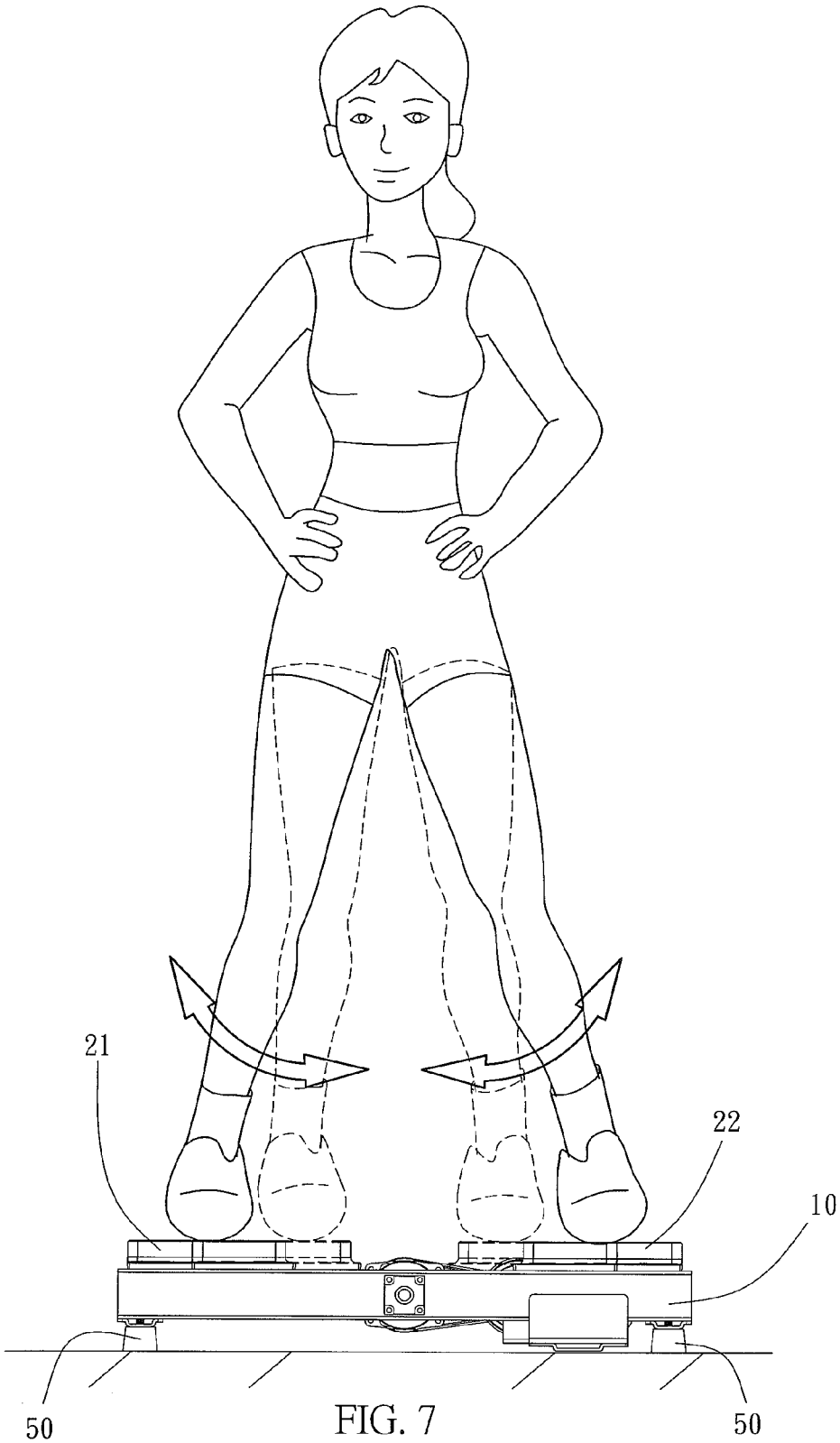
FIG. 7 is a schematic view of a stretching workout carried out according to the present invention.

Referring to FIG. 1 through FIG. 7, the present invention provides a lower limb stretching workout device, comprising a frame unit 10, two sliding plates 21, 22, a motor assembly 30, and two cranks 41, 42.

The frame unit 10 has two guide rails 11, 12 opposing each other.

A plurality of rollers 211, 221 is disposed at two edges of each of the two sliding plates 21, 22. The rollers 211, 221 are slidingly movable along the two guide rails 11, 12 and within a guiding range.

The motor assembly 30 drives a rotating shaft 32 through a transmission module 31.

The two cranks 41, 42 each have a driving end 411, 421 pivotally connected to a cam 43, 44. The two cranks 41, 42 each have an acting end 412, 422 pivotally connected to a lug 212, 222 at the bottom surface of each of the two sliding plates 21, 22. Hence, when the motor assembly 30 drives the transmission module 31 such that the transmission module 31 drives the rotating shaft 32 to rotate, the torque of the rotating shaft 32 is converted by the cam 43, 44 into a push and a pull for driving the two cranks 41, 42. The two cranks 41, 42 push and pull the two sliding plates 21, 22, respectively, such that the two sliding plates 21, 22 slidingly move toward each other and away from each other. A user's two feet rest on the two sliding plates 21, 22, respectively, to extend and flex together with the two sliding plates 21, 22, thereby stretching the user's lower limbs by extension and flexion.

Regarding the lower limb stretching workout device, an idle wheel 45 is fixed to the rotating shaft 32 and adapted to preclude any dead point of the rotation motion of the two cranks 41, 42.

Regarding the lower limb stretching workout device, the cams 43, 44 are each enclosed snugly by a bearing 46, and the bearing 46 is disposed snugly in a round hole 4111, 4211 at the driving end 411, 421 of the cranks 41, 42.

Regarding the lower limb stretching workout device, the motor assembly 30 comprises a motor holder 33, a motor 34, and a motor spindle 341. The motor 34 is fastened to the motor holder 33. The motor spindle 341 penetrates the motor 34 and protrudes from one side of the motor 34 to reach the motor holder 33.

Regarding the lower limb stretching workout device, the transmission module 31 comprises first, second, third and fourth belt pulleys 311, 312, 313, 314, first and second belts 315, 316, and an axle rod 317. The axle rod 317 is fixed to the motor holder 33. The first belt pulley 311 is fixed to the motor spindle 341. The fourth belt pulley 314 is fixed to the rotating shaft 32. The second and third belt pulleys 312, 313 are fixed to each other. The second and third belt pulleys 312, 313 are pivotally connected to the axle rod 317. The first belt 315 is wound around the first and second belt pulleys 311, 312. The second belt 316 is wound around the third and fourth belt pulleys 313, 314.

Regarding the lower limb stretching workout device, a plurality of legs 50 is disposed at the periphery of the bottom of the frame unit 10, such that the frame unit 10 rests on the floor through the plurality of legs 50.

Given its aforesaid constituent elements, the lower limb stretching workout device lies flat on the floor, such that the user's lower limbs rest on the sliding plates 21, 22, respectively. As soon as the motor assembly 30 is started to rotate, the motor assembly 30 drives the transmission module 31, and the transmission module 31 drives the rotating shaft 32 to rotate, such that the torque of the rotating shaft 32 is converted by the cam 43, 44 into a push and a pull for driving the two cranks 41, 42. The two cranks 41, 42 push and pull the two sliding plates 21, 22, respectively, such that the two sliding plates 21, 22 slidingly move toward each other and away from each other. The user's two feet rest on the two sliding plates 21, 22, respectively, to extend and flex together with the two sliding plates 21, 22, thereby stretching the user's lower limbs by extension and flexion.

Accordingly, the lower limb stretching workout device of the present invention is novel and thus meets the novelty requirement of patentability. The lower limb stretching workout device of the present invention is entirely innovative and thus meets the non-obviousness requirement of patentability. The lower limb stretching workout device of the present invention has industrial applicability, because it is characterized in that: a motor assembly drives two cams; the two cams drive two cranks to pull two sliding plates to slidingly move toward each other and away from each other; and a user's two feet rest on the two sliding plates, respectively, to stretch the user's lower limbs by extension and flexion.

What is claimed is:

1. A lower limb stretching workout device, comprising:

a frame unit having two guide rails opposing each other;

two sliding plates each with two edges having a plurality of rollers slidingly movable along the two guide rails and within a guiding range;

a motor assembly for driving a rotating shaft through a transmission module, the motor assembly comprising a motor holder, a motor, and a motor spindle, the motor being fastened to the motor holder, the motor spindle penetrating the motor and protruding from a side of the motor to reach the motor holder, the transmission module comprising first through fourth belt pulleys, first and second belts, and an axle rod, the axle rod being fixed to the motor holder, the first belt pulley being fixed to the motor spindle, the fourth belt pulley being fixed to the rotating shaft, the second and third belt pulleys being fixed to each other, the second and third belt pulleys being pivotally connected to the axle rod, the first belt being wound around the first and second belt pulleys, the second belt being wound around the third and fourth belt pulleys; and the two cranks each having a driving end and an acting end, the driving end being pivotally connected to a cam, and the acting end being pivotally connected to a lug at a bottom surface of each of the two sliding plates, wherein, when the motor assembly drives the transmission module such that the transmission module drives the rotating shaft to rotate, a torque of the rotating shaft is converted by the cams into a push and a pull for driving the two cranks to push and pull the two sliding plates, thereby causing the two sliding plates to slidingly move toward each other and away from each other.

2. The lower limb stretching workout device of claim 1, wherein an idle wheel is fixed to the rotating shaft and adapted to preclude any dead point of rotation motion of the two cranks.

3. The lower limb stretching workout device of claim 1, wherein the cam is enclosed snugly by a bearing, and the bearing is disposed snugly in a round hole at the driving end of each of the cranks.

4. The lower limb stretching workout device of claim 1, wherein a plurality of legs is disposed at a periphery of a bottom of the frame unit, such that the frame unit rests on a floor through the legs.

* * * * *